US008816950B2

(12) United States Patent
Han et al.

(10) Patent No.: US 8,816,950 B2
(45) Date of Patent: Aug. 26, 2014

(54) TIMING CONTROLLER AND DISPLAY APPARATUS HAVING THE SAME

(75) Inventors: Young-Su Han, Incheon (KR); Po-Yun Park, Asan-si (KR)

(73) Assignee: Samsung Display Co., Ltd. (KR)

( * ) Notice: Subject to any disclaimer, the term of this patent is extended or adjusted under 35 U.S.C. 154(b) by 1205 days.

(21) Appl. No.: 12/364,868

(22) Filed: Feb. 3, 2009

(65) Prior Publication Data

US 2010/0053146 A1 Mar. 4, 2010

(30) Foreign Application Priority Data

Aug. 30, 2008 (KR) ..... 10-2008-0081461

(51) Int. Cl.
*G09G 3/36* (2006.01)

(52) U.S. Cl.
USPC ..... 345/99; 345/96; 345/204; 345/691

(58) Field of Classification Search
USPC ..... 345/98–99, 204, 212–213
See application file for complete search history.

(56) References Cited

U.S. PATENT DOCUMENTS

| | | | | |
|---|---|---|---|---|
| 2007/0152945 | A1* | 7/2007 | Park et al. | 345/98 |
| 2007/0262943 | A1 | 11/2007 | Kang | |
| 2008/0001896 | A1* | 1/2008 | Okamura | 345/98 |
| 2008/0106535 | A1* | 5/2008 | Kim et al. | 345/205 |

FOREIGN PATENT DOCUMENTS

| | | | |
|---|---|---|---|
| CN | 1577462 | A | 2/2005 |
| JP | 10247077 | A | 9/1998 |
| JP | 10301544 | A | 11/1998 |
| JP | 2002-311905 | A | 10/2002 |
| JP | 2008015006 | A | 1/2008 |

* cited by examiner

*Primary Examiner* — William Boddie
*Assistant Examiner* — Alecia D English
(74) *Attorney, Agent, or Firm* — Cantor Colburn LLP

(57) ABSTRACT

In a timing controller and a display apparatus, the timing controller generates an internal enable signal based on an external enable signal and processes image data using the internal enable signal. The timing controller determines a width of each of the plurality of pulses of the external enable signal and subtracts a predetermined reference value from the count value to generate a control signal faster than an effective period of the external enable signal. The control signal is applied to a driver which drives a display panel on which an image is displayed. In an exemplary embodiment, the control signal serves as a vertical start signal which starts an operation of a gate driver applying a gate signal to the display panel, thus preventing or effectively eliminating a delay of the image data applied to the display panel.

15 Claims, 5 Drawing Sheets

TIMING CONTROLLER AND DISPLAY APPARATUS HAVING THE SAME

This application claims priority to Korean Patent Application No. 2008-81461, filed on Aug. 20, 2008, and the benefits accruing therefrom under 35 U.S.C. §119, the contents of which in its entirety are herein incorporated by reference.

BACKGROUND OF THE INVENTION

1. Field of the Invention

The present invention relates to a timing controller and a display apparatus having the timing controller. More particularly, the present invention relates to a timing controller capable of simplifying a logic circuit and decreasing a delay time of image data.

2. Description of the Related Art

In general, a liquid crystal display includes a driving unit to drive a display panel which displays an image. The driving unit includes a timing controller, a data driver and a gate driver.

The timing controller generates various control signals in response to a data enable signal applied from an external device. The timing controller also receives image data from the external device and converts the image data into image data capable of being processed in the data driver.

The data enable signal includes an effective period during which the processed image data are applied to the data driver and a blanking period during which the processed image data are not applied to the data driver. The timing controller generates the control signals during the effective period of the data enable signal and applies the control signals to the gate and data drivers.

However, since the image data are applied to the data driver in synchronization with the control signals and the control signals are generated after starting the effective period of the data enable signal, the image data are delayed.

In addition, in the event that an internal enable signal is generated based on the data enable signal, the image data are delayed even more since the control signals are generated depending on the internal enable signal.

BRIEF SUMMARY OF THE INVENTION

An exemplary embodiment of the present invention provides a timing controller capable of simplifying a logic circuit and decreasing a delay time of image data.

Another exemplary embodiment of the present invention also provides a display apparatus having the above described timing controller.

In an exemplary embodiment of the present invention, a timing controller includes a counter, a memory, a comparator and a pulse generator. The counter receives an enable signal having a plurality of pulses each of which includes an effective period and a blank period, and determines a width of each pulse by counting pulses of the enable signal. The memory sequentially stores a count value of each pulse. The comparator reads out the count value of a previous pulse of the plurality of pulses previously stored in the memory and subtracts a predetermined reference value from the count value of the previous pulse to output a comparison value. The pulse generator generates a control signal within the blank period of the previous pulse based on the comparison value, the control signal is used for a present signal.

In another exemplary embodiment of the present invention, a display apparatus includes a timing controller and a panel module. The timing controller generates a plurality of control signals and image data in response to an external enable signal having a plurality of pulses each of which includes an effective period and a blank period. The panel module includes a display panel which displays an image in response to the image data and a driver which controls the display panel in response to the control signals.

In addition, the timing controller includes an internal enable signal generator, a data processor, a first signal processor and a second signal processor. The internal enable signal generator converts the external enable signal into an internal enable signal using a predetermined first reference clock. The data processor converts the image data based on the internal enable signal. The first signal processor generates a first control signal generated faster than the effective period of the external enable signal using the external enable signal and a predetermined second reference clock and applies the first control signal to the driver. The second signal processor generates a second control signal based on the internal enable signal and applies the second control signal to the driver.

According to the above, the timing controller generates the internal enable signal based on the external enable signal and uses the internal enable signal to process the data and the signals. Also, the timing controller determines the width of each of the plurality of pulses of the external enable signal and generates control signals applied to the driver for the display panel using the count value. Particularly, the timing controller generates the vertical start signal applied to the gate driver or the inversion signal applied to the data driver, thereby preventing or effectively eliminating the delay of the image data applied to the display panel.

BRIEF DESCRIPTION OF THE DRAWINGS

The above and other aspects, features and advantages of the present invention will become readily apparent by reference to the following detailed description when considered in conjunction with the accompanying drawings in which.

DETAILED DESCRIPTION OF THE INVENTION

Figure 1:
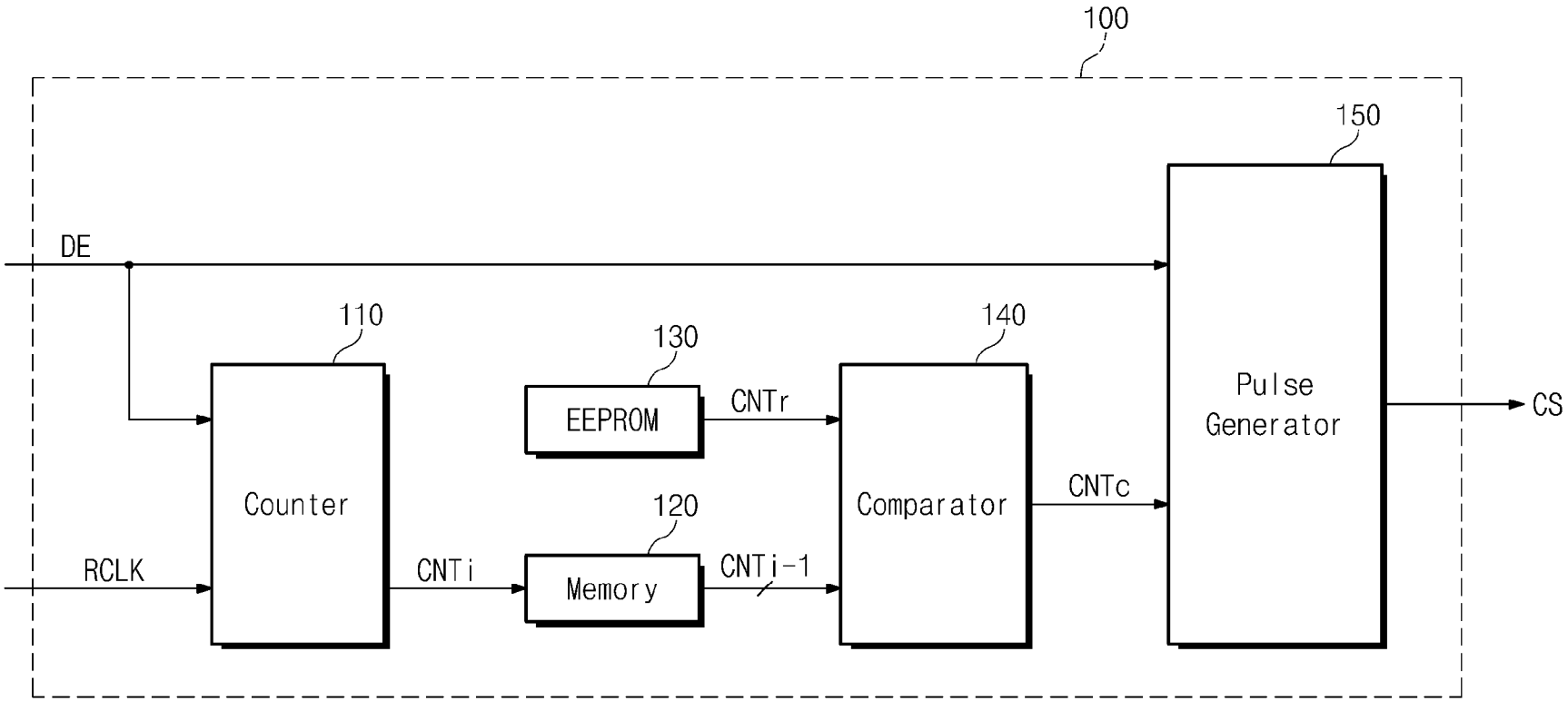
FIG. 1 is a block diagram illustrating an exemplary embodiment of a timing controller according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, the present invention will be explained in further detail with reference to the accompanying drawings.

Figure 2:
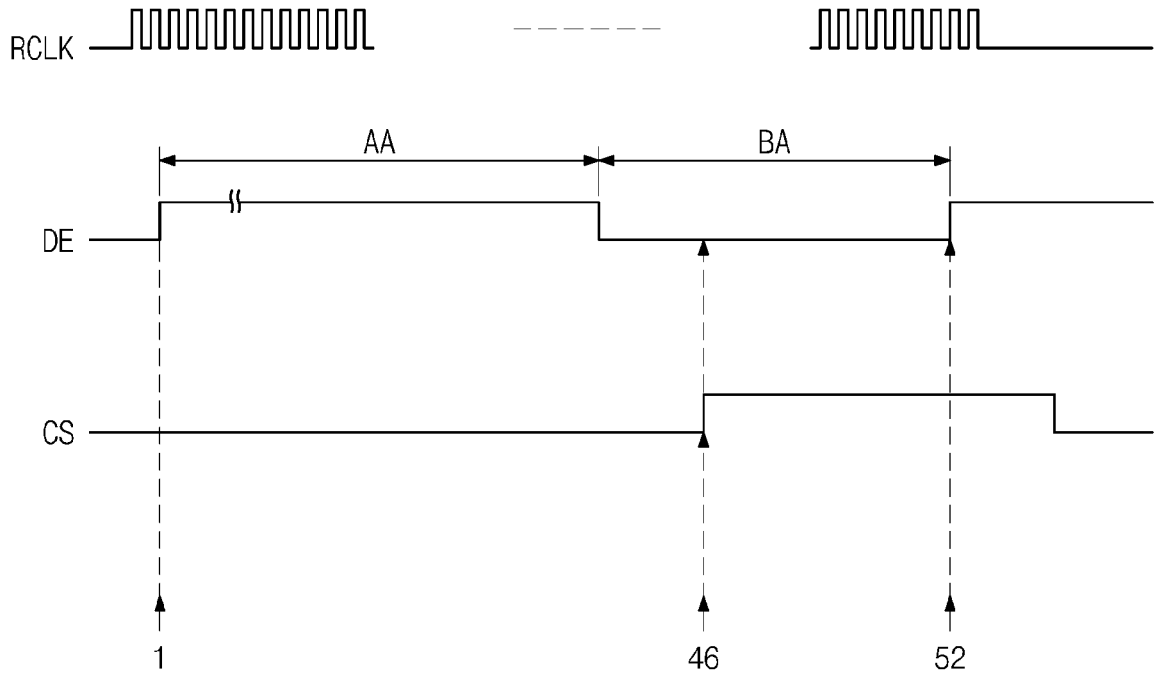
FIG. 2 is a diagram illustrating waveforms of signals shown in FIG. 1.

FIG. 1 is a block diagram illustrating an exemplary embodiment of a timing controller according to the present invention. FIG. 2 is a diagram illustrating waveforms of signals shown in FIG. 1.

Referring to FIGS. 1 and 2, a timing controller 100 includes a counter 110, a memory 120, an electrically erasable programmable read-only memory ("EEPROM") 130, a comparator 140 and a pulse generator 140.

The counter 110 receives an enable signal DE having a plurality of pulses from an external device (not shown) and counts a number of pulses of a predetermined reference clock RCLK with respect to each pulse of the enable signal DE.

Although not shown in FIGS. 1 and 2, the timing controller 100 is used for the display apparatus, and thus the timing controller 100 receives external control signals from the external device in order to generate image data and control signals for the display apparatus. The display apparatus to which the timing controller 100 is applied will be described in further detail with reference to FIGS. 3 and 4 below.

As shown in FIG. 2, each pulse of the enable signal DE includes an effective period AA and a blank period BA. The effective period AA is defined as a period during which the image data are output from the timing controller 100, and the blank period BA is defined as a period during which the image data are not output from the timing controller 100.

In the present exemplary embodiment, the counter 110 counts the number of pulses of the reference clock RCLK which occur during the effective period AA and the blank period of each pulse of the enable signal DE. This means that the counter 110 determines a pulse width of each pulse of the enable signal DE. As another example, the counter 110 may count the number of pulses of the reference clock RCLK which occur during the blank period BA of each pulse of the enable signal DE, and this means that the counter 110 determines the width of the blank period BA.

The count value CNTi corresponding to the pulse width of each pulse of the enable signal DE is sequentially stored in the memory 120. The count value CNTi may be represented by a bit combination. The pulse width may be represented as binary number or decimal number by using the count value CNTi. The memory 120 sequentially stores the count values output from the counter 110 every pulse of the enable pulse DE.

Meanwhile, the EEPROM 130 stores previous information about generation timing of the control signals. Particularly, the EEPROM 130 stores the information as a numerical value, which indicates how much faster the control signals are generated than the effective period AA of each pulse. In the present exemplary embodiment, the information stored in the EEPROM 130 is defined as a reference value CNTr.

The comparator 140 reads out a count value CNTi-1 of a previous pulse of the enable signal DE from the memory 120 and reads out the reference value CNTr from the EEPROM 130. The comparator 140 subtracts the reference value CNTr from the count value CNTi-1 of the previous pulse and outputs a comparison value CNTc which determines the generation timing of the control signal CS. The comparison value CNTc output from the comparator 140 is applied to the pulse generator 150.

When assuming that the count value CNTi-1 of the previous pulse is 52 and the reference value CNTr is 6, for example as illustrated in FIG. 2, the comparison value CNTc is 46. The pulse generator 150 outputs the control signal CS when the count value becomes 46 while counting a next pulse of the enable signal DE. In the present exemplary embodiment, the reference value CNTr is less than the count value of the blank period BA. This is because the control signal CS may be generated before finishing the effective period AA in the event that the reference value CNTr is greater than the count value of the blank period BA. Accordingly, the reference value CNTr is set to be less than the count value of the blank period BA, so that the control signal CS may be generated in the blank period BA of the previous pulse.

In addition, as an example of the present invention, the control signal CS may be a vertical start signal or an inversion signal. The vertical start signal and the inversion signal will be described in further detail below with reference to FIG. 3.

As described above, the control signal CS is generated based on the count value of the previous pulse prior to starting the effective period AA, thereby decreasing the delay of the image data.

Figure 3:
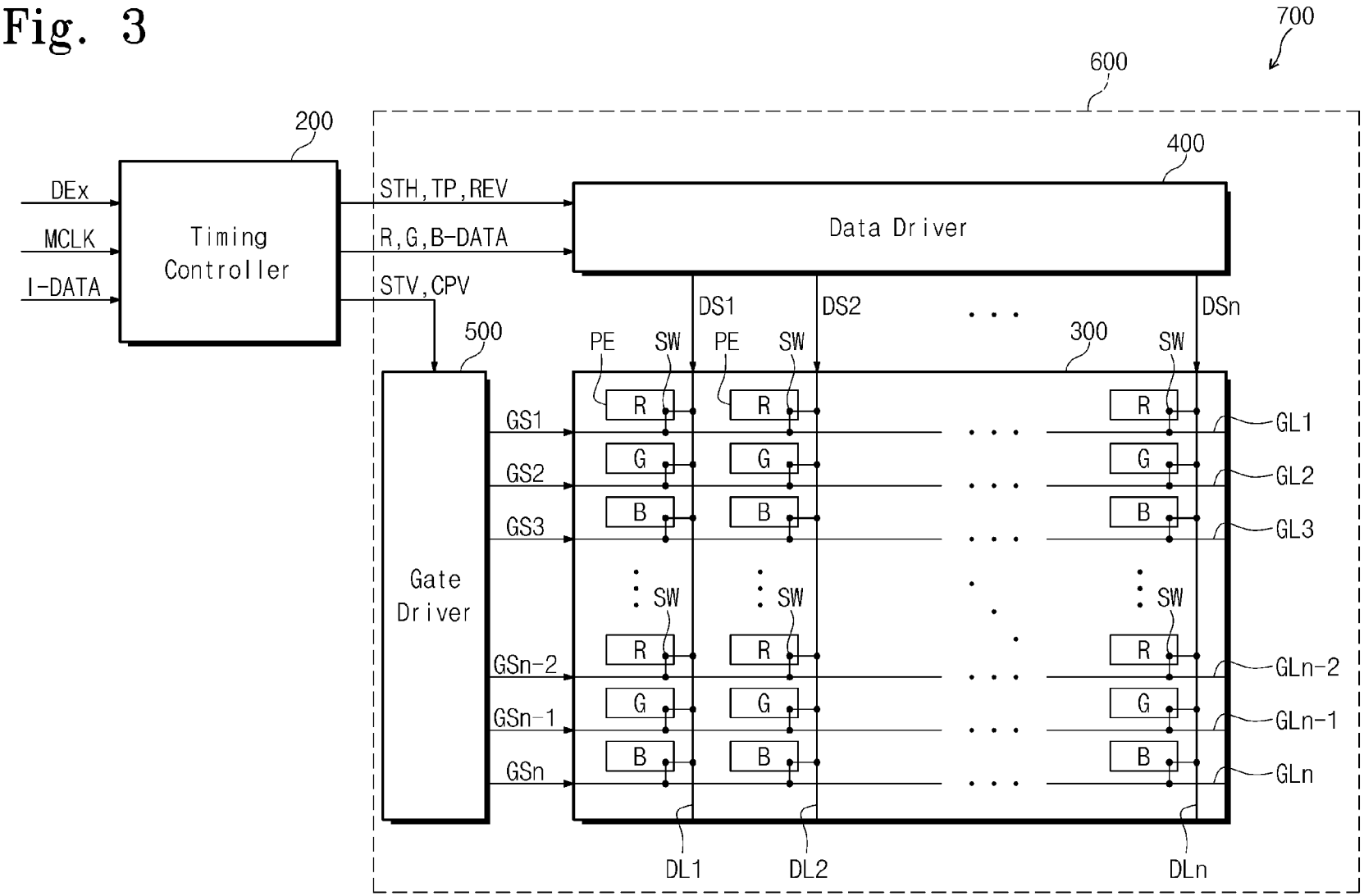
FIG. 3 is a block diagram illustrating an exemplary embodiment of a display apparatus according to the present invention.
Figure 4:
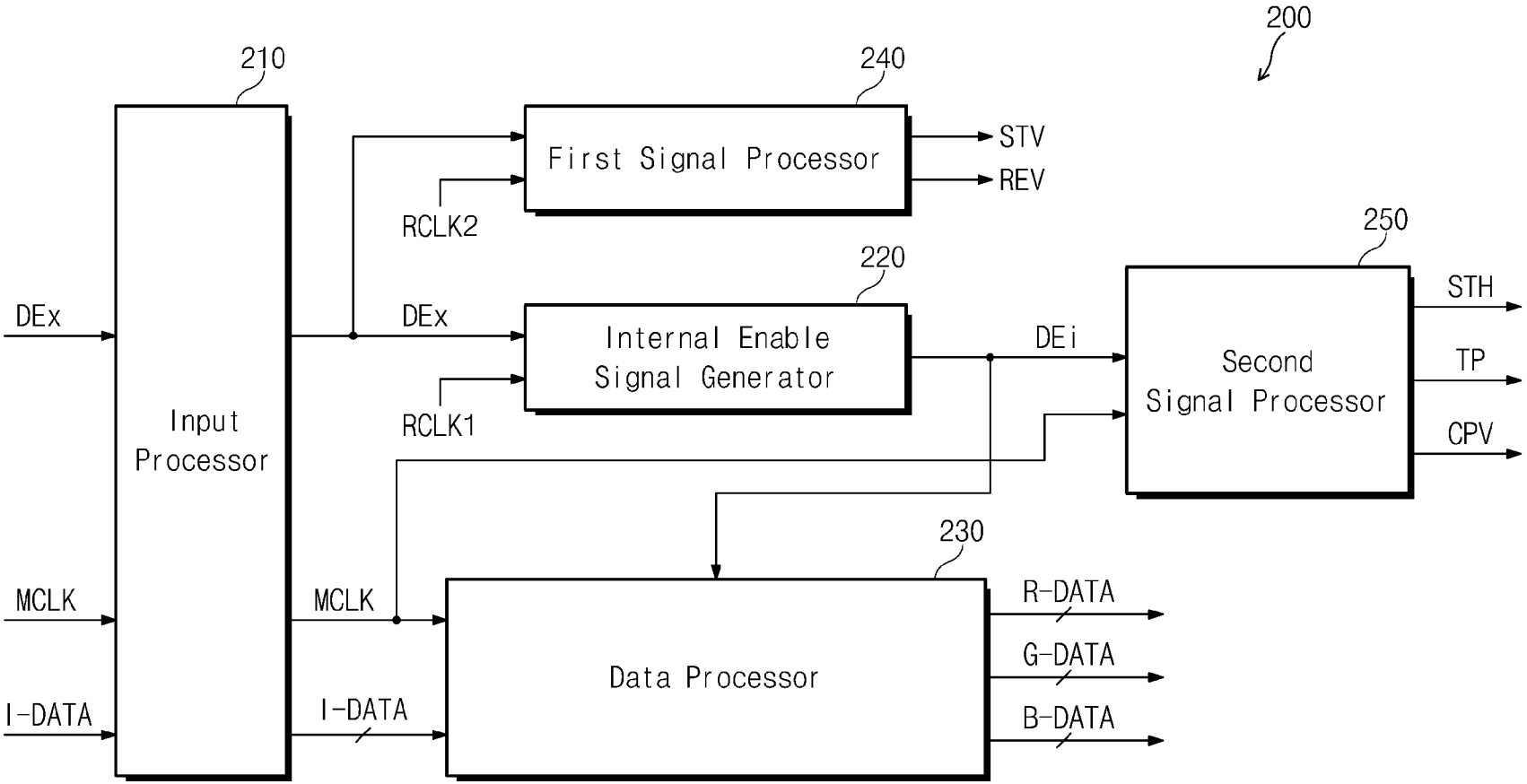
FIG. 4 is a block diagram illustrating a timing controller shown in FIG. 3.
Figure 5:
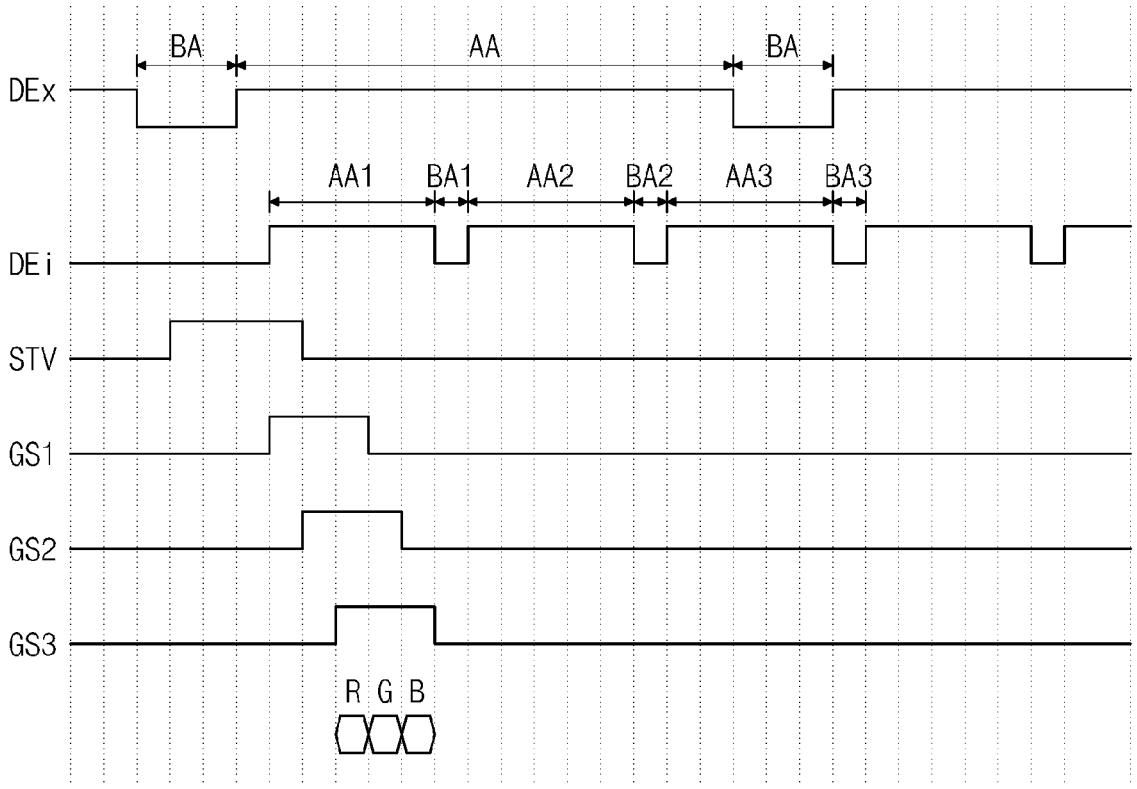
FIG. 5 is a diagram illustrating waveforms of signals shown in FIGS. 3 and 4.

FIG. 3 is a block diagram illustrating an exemplary embodiment of a display apparatus according to the present invention. FIG. 4 is a block diagram illustrating a timing controller shown in FIG. 3. FIG. 5 is a diagram illustrating waveforms of signals shown in FIGS. 3 and 4.

Referring to FIG. 3, a display apparatus 700 includes a timing controller 200 and a panel module 600. The timing controller 200 receives an external enable signal DEx, a main clock signal MCLK, and image data I-DATA.

As shown in FIG. 4, the timing controller 200 includes an input processor 210, an internal enable signal generator 220, a data processor 230, a first signal processor 240 and a second signal processor 250.

The input processor 210 transmits the external enable signal DEx to the internal enable signal generator 220 and the first signal processor 240, transmits the main clock signal MCLK to the data processor 230 and the second signal processor 250, and transmits the image data I-DATA to the data processor 230. The input processor 210 may be an interface to electrically connect the external device (not shown) and the timing controller 200. The external device may be a computer system (not shown) or a graphic controller (not shown).

As shown in FIG. 5, the external enable signal DEx includes a plurality of pulses each of which includes an effective period AA during which the image data I-DATA are output to the data processor 230 and a blank period BA during which the image data I-DATA are not output. Thus, the effective period AA and the blank period BA may be defined as one period of each pulse of the external enable signal DEx.

The internal enable signal generator 220 receives the external enable signal DEx and a predetermined first reference clock RCLK1 and converts the external enable signal DEx into an internal enable signal DEi using the first reference clock RCLK1. The internal enable signal DEi generated by the internal enable signal generator 220 is applied to the data processor 230 and the second signal processor 250.

In the present exemplary embodiment, the internal enable signal DEi may have a frequency i (where i is a constant number equal to or greater than 2) times higher than that of the external enable signal DEx. When assuming that i is 3 as in FIG. 5, the internal enable signal DEi includes first to third effective periods AA1, AA2 and AA3 and first to third blank period BA1, BA2 and BA3 corresponding to one period of one pulse of the external enable signal DEx. Each of the first, second and third effective periods AA1, AA2 and AA3 has a width corresponding to ⅓ period of the effective period AA of the external enable signal DEx, and each of the first, second and third blank periods BA1, BA2 and BA3 has a width corresponding to ⅓ period of the blank period BA of the external enable signal Dex, as illustrate in FIG. 5.

Referring again to FIG. 4, the data processor 230 receives the main clock signal MCLK and the image data I-DATA and converts the image data I-DATA into red data R-DATA, green data G-DATA and blue data B-DATA based on the internal enable signal DEi. The red, green and blue data R-DATA, G-DATA and B-DATA are applied to the panel module 600 in synchronization with the main clock signal MCLK.

The data processor 230 outputs the red, green and blue data R-DATA, G-DATA and B-DATA during the effective period AA of the internal enable signal DEi and does not output the red, green and blue data R-DATA, G-DATA and B-DATA during the blank period BA of the internal enable signal DEi.

The first signal processor 240 includes the same block configuration as that of the timing controller 100 shown in FIG. 1. The first signal processor 240 receives the external enable signal DEx and a predetermined second reference clock RCLK2 and counts a pulse width of the external enable signal DEx based on the second reference clock RCLK2. The first signal processor 240 subtracts a predetermined reference value from the count value to generate a vertical start signal STV and an inversion signal REV faster than the start timing of the effective period AA of the external enable signal DEx. The vertical start signal STV and the inversion signal REV are applied to the panel module 600.

The second signal processor 250 generates a horizontal start signal STH, an output start signal TP and a gate clock signal CPV based on the internal enable signal DEi and applies the horizontal start signal STH, the output start signal TP and the gate clock signal CPV to the panel module 600.

As shown in FIG. 3, the display module 600 includes a display panel 300, a data driver 400 and a gate driver 500.

The data driver 400 receives red, green and blue data R-DATA, G-DATA and B-DATA from the timing controller 200 and outputs a plurality of data signals DS~DSn in an analog form in response to the horizontal start signal STH, the output start signal TP and the inversion signal REV. The data signals DS1~DSn are applied to the display panel 300. In the present exemplary embodiment, the horizontal start signal STH indicates a start of the data signals DS1~DSn, the output start signal TP determines an output timing of the data signals DS1~DSn from the data driver 400, and the inversion signal REV inverts a polarity of the data signals DS1~DSn.

The gate driver 500 sequentially outputs a plurality of gate signals GS1~GSn in response to the vertical start signal STV and the gate clock signal CPV. The gate signals GS1~GSn are applied to the display panel 300. The vertical start signal STV starts an operation of the gate driver 500, and the gate clock signal CPV determines an output timing of the gate signals GS1~GSn from the gate driver 500.

Referring to FIG. 5, the vertical start signal STV is generated before the first effective period AA1 starts, and the gate signals GS1~GSn are sequentially output from the gate driver 500 after a predetermined time interval lapses. As described above, the vertical start signal STV is generated faster than the internal enable signal DEi, so that the output timing of the first gate signal GS1 becomes faster.

Particularly, in the case where a precharge period exists in a high period of each gate signal such that the precharge period precedes a period during which substantial data are applied, even though the first effective period AA1 of the internal enable signal DEi starts, the substantial data are applied after the predetermined time interval lapses. Accordingly, the delay of the image data may occur in the display panel 300 to which a precharge scheme is applied.

However, the output timing of the vertical start signal STV becomes faster according to the above-described scheme, thereby decreasing the delay time of the image data occurring in the display panel to which a precharge scheme is applied.

Referring again to FIG. 3, the display panel 300 includes the gate lines GL1~GLn, the data lines DL1~DLn, a plurality of switching devices SW, and a plurality of pixel electrodes PE.

The gate lines GL1~GLn extend in a first direction and the data lines DL1~DLn are arranged in a second direction substantially perpendicular to the first direction. The gate lines GL1~GLn are electrically connected to the gate driver 500 to sequentially receive the gate signals GS1~GSn.

The data lines DL1~DLn extend in the second direction and are arranged in the first direction. The data lines DL1~DLn are insulated from the gate lines GL1~GLn while crossing the gate lines GL1~GLn. The data lines DL1~DLn are electrically connected to the data driver 400 to receive the data signals DS1~DSn.

Each switching device SW is electrically connected to a corresponding gate line of the gate lines GL1~GLn and a corresponding data line of the data lines DL1~DLn. In addition, each switching device SW is connected to a corresponding pixel electrode of the pixel electrodes PE, and color filters are arranged corresponding to the pixel electrodes PE in one-to-one fashion. The color filters include red, green and blue color pixels R, G and B.

The pixel electrodes PE respectively corresponding to the red, green and blue R, G and B color pixels receive data signals DS1~DSn obtained by converting the red, green and blue data R-DATA, G-DATA and B-DATA, respectively. Thus, three pixels respectively corresponding to the red, green and blue color pixels R, G and B may display a desired image based on the data signals DS1~DSn.

In FIG. 3, the structure in which the red color pixel R, the green color pixel G and the blue pixel B are sequentially arranged along a longitudinal direction of the data lines DL1~DLn illustrates one embodiment, but is not limited to this structure. Accordingly, the red, green and blue color pixels R, G and B may be arranged in various structures and shapes.

According to the timing controller and the display apparatus, the timing controller generates the internal enable signal based on the external enable signal and uses the internal enable signal to process the data and signals. Also, the timing controller determines the width of each pulse of the external enable signal and generates control signals to be applied to the data driver for the display panel using the count value.

Particularly, the timing controller generates the vertical start signal applied to the gate driver or the inversion signal applied to the data driver, thereby preventing or effectively eliminating the delay of the image data applied to the display panel.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A timing controller comprising:

a counter which receives an enable signal having a plurality of pulses each of which includes an effective period and a blank period, and determines a width of each of the plurality of pulses of the enable signal;

a memory connected to the counter and which sequentially stores a count value of each of the plurality of pulses;

a comparator which reads out the count value of a previous pulse of the plurality of pulses previously stored in the memory and subtracts a predetermined reference value from the count value of the previous pulse to output a comparison value; and a pulse generator which generates a control signal within the blank period of the previous pulse based on the comparison value, the control signal is generated based on the count value of the previous pulse prior to starting the effective period of the present pulse signal of the enable signal.

2. The timing controller of claim 1, wherein the counter receives a reference clock and counts a number of pulses of the reference clock generated in the effective period and the blank period of each of the plurality of pulses of the enable signal.

3. The timing controller of claim 1, wherein the counter receives a reference clock and counts a number of pulses of the reference clock generated in the blank period of each of the plurality of pulses of the enable signal.

4. The timing controller of claim 3, wherein the predetermined reference value is less than the count value of the blank period.

5. The timing controller of claim 1, further comprising an electrically erasable programmable read-only memory which stores the predetermined reference value therein.

6. A display apparatus comprising:

a timing controller which generates a plurality of control signals and image data in response to an external enable signal having a plurality of pulses each of which includes an effective period and a blank period; and a panel module including a display panel which displays an image in response to the image data and a driver which controls the display panel in response to the control signals, wherein the timing controller comprises:

an internal enable signal generator which converts the external enable signal into an internal enable signal using a predetermined first reference clock;

a data processor which converts the image data based on the internal enable signal;

a first signal processor which generates a first control signal generated faster than the effective period of the external enable signal using the external enable signal and a predetermined second reference clock and applies the first control signal to the driver; and a second signal processor which generates a second control signal based on the internal enable signal and applies the second control signal to the driver, wherein the first signal processor comprises:

a counter which receives the external enable signal to determine a width of each of the plurality of pulses;

a memory connected to the counter and which sequentially stores a count value of each of the plurality of pulses;

a comparator which reads out the count value of a previous pulse of the plurality of pulses previously stored in the memory and subtracts a predetermined reference value from the count value of the previous pulse to output a comparison value; and a pulse generator which generates the first control signal within the blank period of the previous pulse based on the comparison value, the first control signal is generated based on the count value of the previous pulse prior to starting the effective period of the present pulse signal of the external enable signal.

7. The display apparatus of claim 6, wherein the counter receives the second reference clock and counts a number of pulses of the second reference clock generated in the effective period and the blank period of each of the plurality of pulses of the external enable signal.

8. The display apparatus of claim 6, wherein the counter receives the second reference clock and counts a number of pulses of the second reference clock generated in the blank period of each of the plurality of pulses of the external enable signal.

9. The display apparatus of claim 8, wherein the predetermined reference value is less than the count value of the blank period.

10. The display apparatus of claim 6, further comprising an electrically erasable programmable read-only memory which stores the predetermined reference value therein.

11. The display apparatus of claim 6, wherein the internal enable signal generator frequency-divides i times the external enable signal to generate the internal enable signal having i pulses corresponding to the plurality of pulses of the external enable signal, respectively, wherein i is a constant number equal to or greater than 2.

12. The display apparatus of claim 11, wherein each of the plurality of pulses of the internal enable signal comprises an internal effective period corresponding to ⅓ period of the external enable signal and an internal blank period corresponding to ⅓ period of the external enable signal.

13. The display apparatus of claim 6, wherein the driver comprises:

a data driver which applies a data signal to the display panel; and a gate driver which sequentially applies a gate signal to the display panel.

14. The display apparatus of claim 13, wherein the first control signal comprises a vertical start signal which starts an operation of the gate driver.

15. The display apparatus of claim 13, wherein the first control signal comprises an inversion signal which inverts a polarity of the data signal output from the data driver.

* * * * *